US007762875B2

(12) United States Patent
Sekimoto

(10) Patent No.: US 7,762,875 B2
(45) Date of Patent: Jul. 27, 2010

(54) BLOWER CONTROLLER FOR ELEVATOR SYSTEM

(75) Inventor: Yoichi Sekimoto, Tachikawa (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 123 days.

(21) Appl. No.: 10/547,394

(22) PCT Filed: Jun. 29, 2004

(86) PCT No.: PCT/JP2004/009493

§ 371 (c)(1),
(2), (4) Date: Mar. 12, 2008

(87) PCT Pub. No.: WO2006/001082

PCT Pub. Date: Jan. 5, 2006

(65) Prior Publication Data

US 2008/0207106 A1 Aug. 28, 2008

(51) Int. Cl.
*F24F 7/007* (2006.01)
*B66B 11/02* (2006.01)
*B66B 1/06* (2006.01)

(52) U.S. Cl. ..... 454/68; 454/255; 187/393; 187/413; 187/414

(58) Field of Classification Search ..... 454/68, 454/238, 255; 187/393, 413, 414
See application file for complete search history.

(56) References Cited

U.S. PATENT DOCUMENTS 5,593,347 A * 1/1997 Mandy et al. ..... 454/68
7,267,203 B2 * 9/2007 Sekimoto ..... 187/393

FOREIGN PATENT DOCUMENTS

| | | | |
|---|---|---|---|
| JP | 04101985 | A * | 4/1992 |
| JP | 4-256677 | | 9/1992 |
| JP | 06-312890 | | 11/1994 |
| JP | 09077430 | A * | 3/1997 |
| JP | 10-036042 | | 2/1998 |
| JP | 10-182039 | | 7/1998 |
| JP | 10-226477 | | 8/1998 |
| JP | 11-071077 | | 3/1999 |
| JP | 2003118943 | | 4/2003 |
| JP | 2003118943 | A * | 4/2003 |

* cited by examiner

*Primary Examiner*—Steven B McAllister
*Assistant Examiner*—Patrick F. O'Reilly, III
(74) *Attorney, Agent, or Firm*—Oblon, Spivak, McClelland, Maier & Neustadt, L.L.P.

(57) ABSTRACT

An elevator system includes a mode switch configured to select one of a plurality of operation modes based on a state of the elevator cage, and a blower controller configured to control a blower to adjust pressure inside an elevator cage according to the selected operation mode.

8 Claims, 3 Drawing Sheets

BLOWER CONTROLLER FOR ELEVATOR SYSTEM

TECHNICAL FIELD

The present invention relates to an elevator system for adjusting air pressure in an elevator cage.

BACKGROUND ART

In a high speed elevator in multistory buildings, elevator passengers suffer from popped ears and feel discomfort because of rapid pressure change. Especially, a modern high speed elevator, which travels more than 400 meter in height at speeds over 1000 meter per minute, requires a pressure control system. In the related art, a method which automatically controls air pressure in an elevator cage has been proposed.

DISCLOSURE OF INVENTION

The related art fails to disclose an elevator system controlling the pressure based on states of the elevator cage and the pressure in the elevator cage.

It is an object of the present invention to provide an elevator system that gives passengers a comfortable ride by controlling the air pressure based on states of the elevator cage and the pressure in the elevator cage.

An aspect of the present invention inheres in an elevator system including a mode switch configured to select one of a plurality of operation modes based on a state of the elevator cage, and a blower controller configured to control a blower so as to adjust pressure inside an elevator cage, according to the selected operation mode.

BEST MODE FOR CARRYING OUT THE INVENTION

Figure 1:
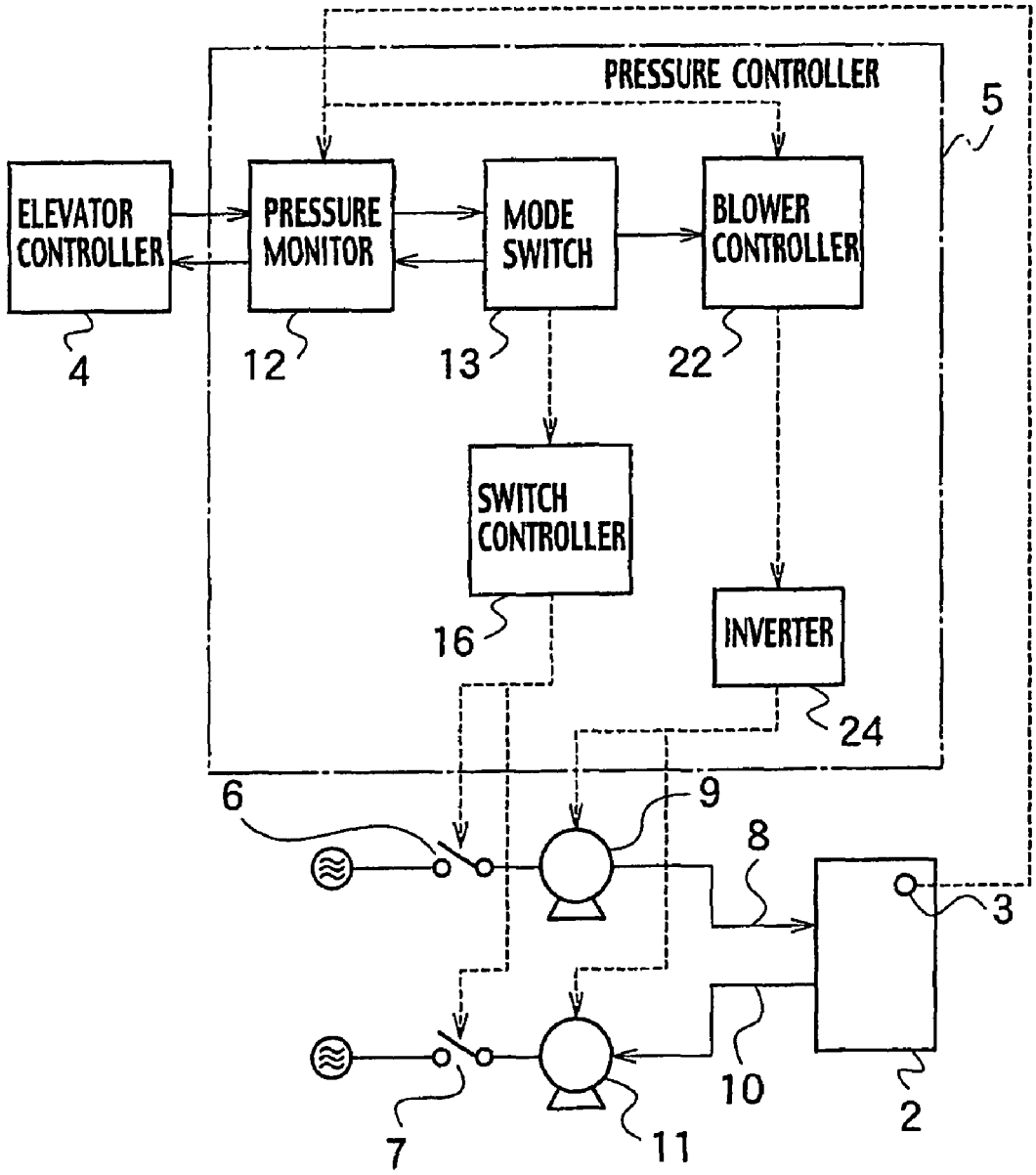
FIG. 1 is a block diagram schematically showing the elevator system of the embodiment of the present invention.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

In the following description specific details are set fourth, such as specific materials, process and equipment in order to provide thorough understanding of the present invention. It will be apparent, however, to one skilled in the art that the present invention may be practiced without these specific details. In other instances, well-known manufacturing materials, process and equipment are not set forth in detail in order to not unnecessarily obscure the present invention.

As shown in FIG. 1, an elevator system of an embodiment includes an elevator cage or passenger car 2, a pressure sensor 3, an elevator controller 4, a pressure controller 5, an intake switch 6, and an exhaust switch 7. The pressure sensor 3 is provided in the elevator cage to detect air pressure in the elevator cage 2 and to transmit a pressure signal according to the pressure. The elevator controller 4 controls movement of the elevator cage 2 by transmitting a motion signal to raise and lower the elevator cage 2, for example, based on input signals from floor selection buttons provided in the elevator cage 2. The pressure controller 5 generates an intake voltage and an exhaust voltage including a given voltage level and a given frequency based on the pressure in the elevator cage 2. The pressure controller 5 generates also an intake switch signal for the intake switch 6, and an exhaust switch signal for the exhaust switch 7. The intake switch 6 transmits electrical power when the intake switch signal is supplied thereto. The exhaust switch 7 transmits electrical power when the exhaust switch signal is supplied thereto.

Furthermore, the elevator system includes an intake blower 9 and an exhaust blower 11. The intake blower 9 supplies the air to the elevator cage 2 through a duct 8 to increase the pressure by adjusting rotating speed of a motor based on the intake voltage from the pressure controller 5 or the electrical power transmitted through the intake switch 6. The exhaust blower 11 exhausts the air from the elevator cage 2 through a duct 10 to decrease the pressure by adjusting rotating speed of a motor based on the exhaust voltage from the pressure controller 5 or the electrical power transmitted through the exhaust switch 7.

The pressure controller 5 includes a pressure monitor 12, a mode switch 13, a blower controller 22, an inverter 24, and a switch controller 16. The pressure monitor 12 monitors the motion state of the elevator cage 2 based on the motion signal from the elevator controller 4 and the pressure in the elevator cage 2 based on the pressure signal from the pressure sensor 3. Additionally, the pressure monitor 12 requests the elevator controller 4 to control the speed of the elevator cage 2 based on the states of the motion and the pressure. The mode switch 13 selects one of a plurality of operation modes, such as an optimization mode, a constant mode, a stop mode and a switching mode.

Figure 3:
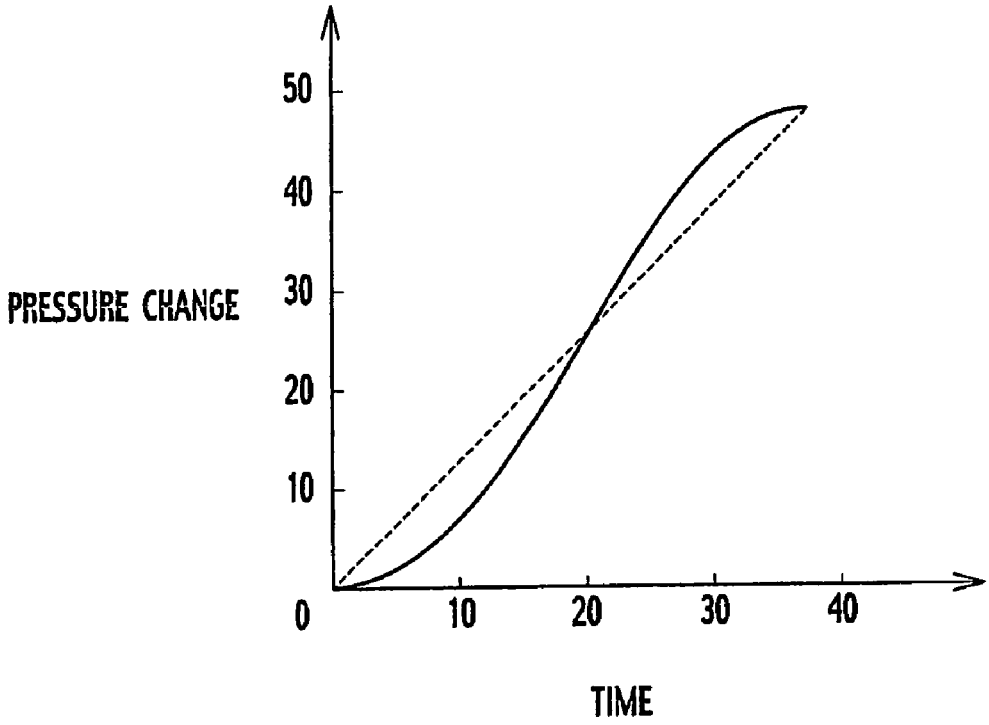
FIG. 3 is a view schematically showing the pressure change in the optimization mode.
Figure 4:
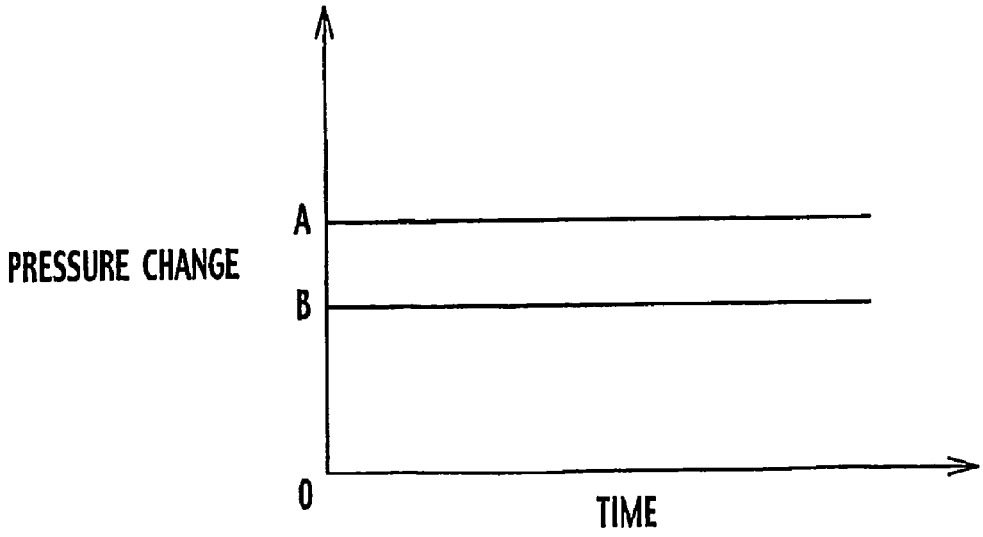
FIG. 4 is a view schematically showing the pressure change in the constant mode.

As shown in FIG. 3, in the optimization mode, the pressure in the elevator cage 2 is optimized as a pressure change (shown in full line) to approximate an optimized pressure change (shown in dashed line) by the blower controller 22 controlling the intake blower 9 and the exhaust blower 11, based on the pressure monitor 12. As shown in FIG. 4, in the constant mode, the pressure in the elevator cage 2 is kept constant by the blower controller 22 which controls the intake blower 9 and the exhaust blower 11 to supply substantially the same air volume as the exhausted air volume. In the stop mode, the ventilation in the elevator cage 2 is stopped. In the switching mode, the switch controller 16 controls the intake switch 6 and the exhaust switch 7 by switching on and off.

The blower controller 22 transmits an intake voltage signal to supply the intake blower 9 with the intake voltage, an exhaust voltage signal to supply the exhaust blower 11 with the exhaust voltage so as to control the air volume of the intake blower 9 and the exhaust blower 11 in the optimization mode or the constant mode. The inverter 24 transmits the intake voltage and the exhaust voltage to operate the intake blower 9 and the exhaust blower 11 according to the intake voltage signal and the exhaust voltage signal from the blower controller 22. The switch controller 16 controls the intake switch 6 and the exhaust switch 7 to switch on and off the intake blower 9 and the exhaust blower 11 in the switching mode.

Figure 2:
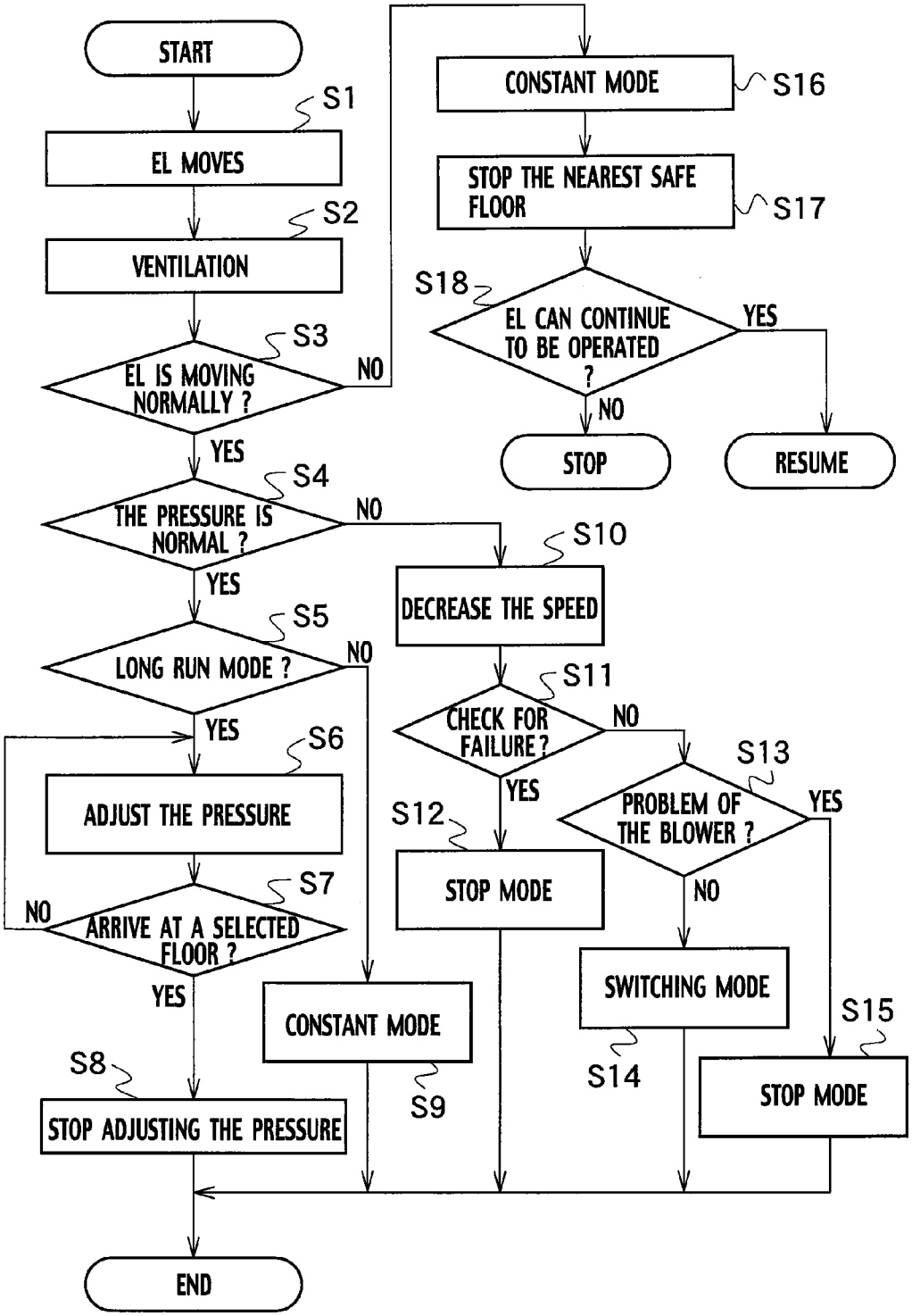
FIG. 2 is a flow chart schematically showing the operation of the embodiment.

The operation of the elevator system is set forth below with reference to FIG. 2. In the step S1, the elevator cage 2 moves up or down. In the step S2, the intake blower 9 and the exhaust blower 11 ventilate the elevator cage 2. In the step S3, the elevator controller 4 and a trouble detector (not shown in figures) determine whether the elevator cage 2 is moving normally. In the step S4, the elevator controller 4 and the trouble detector determine whether the pressure in the elevator cage 2 is normal, based on the pressure signal from the pressure sensor 3, when the elevator cage 2 is moving normally. In the step S5, the elevator controller 4 determines whether the elevator cage 2 is moving in a long run mode, in which the elevator cage 2 moves nonstop for a long distance at high speed. The determination by the controller 4 is based on the motion signal from the elevator controller 4 when the pressure is normal. In the long run mode, the pressure inside the elevator cage 2 is greater than a given pressure. In the step S6, as shown in FIG. 3, the mode switch 13 selects the optimization mode and the intake blower 9 and the exhaust blower 11 adjust the air volume to change the pressure at constant rate as the pressure accords to a pressure outside the elevator cage 2 when the elevator door opens.

In the step S7, the elevator controller 4 determines whether the elevator cage 2 arrives at a selected floor. In the step S8, the pressure controller 5 stops adjusting the pressure when the motion signal representing the arrival is transmitted from the elevator controller 4.

When the elevator cage 2 does not move in the long run mode in the step S5, for example, when the elevator cage 2 travels less than a given distance or a given number of floors, in the step S9, the mode switch 13 selects the constant mode and the intake blower 9 supplies substantially the same volume of air as the exhausted air volume because there is a little difference of pressure between the inside and the outside of the elevator cage 2.

As described above, one of the optimization mode and the constant mode is selected based on the movement distance of the elevator cage 2.

In the step S10, the pressure monitor 12 requests the elevator controller 4 to decrease the speed of the elevator cage 2 to a given speed when the pressure is greater than the given pressure in the optimization mode or the constant mode in the step S4. In the step S11, the elevator controller 4 and the trouble detector check for failure of units in the elevator system. In the step S12, the mode switch 13 selects the stop mode and stops ventilation when the elevator controller 4 and the trouble detector determine the failure is too serious to continue ventilation. In the step S13, the elevator controller 4 and the trouble detector determine a problem with the intake blower 9 or the exhaust blower 11. In the step S14, the mode switch 13 selects the switching mode and the switch controller 16 mode switches on the intake blower 9 and the exhaust blower 11 when the failure results shows that neither of the intake blower 9 nor the exhaust blower 11 have a problem. In the switching mode, the ventilation system is operated based on the switching of the intake switch 6 and the exhaust switch 7. In the step S15, the mode switch 13 selects the stop mode when the failure results show that both of the intake blower 9 and the exhaust blower 11 have a problem. In the stop mode, the contact controller 16 switches off the intake blower 9 and the exhaust blower 11.

In the step S16, the mode switch 13 selects the constant mode when the elevator controller 4 and the trouble detector determine the elevator cage 2 is not moving normally in the step S3. That is, the elevator cage 2 is controlled under a rescue operation or a check operation by the elevator controller 4. In emergencies, such as an earthquake, a fire, a blackout, or a problem of the elevator movement device or windlass, the elevator cage 2 is controlled under the rescue operation or the check operation. In the step S17, the elevator cage 2 stops at the nearest safe floor. In the step S18, the elevator controller 4 and the trouble detector determine whether the elevator cage 2 can continue to be operated. When the elevator cage 2 can continue to be operated, the elevator controller 4 resumes normal operation of the elevator cage 2. When the elevator cage 2 cannot continue to be operated, the elevator controller 4 stops the elevator cage 2.

As described above, according to the elevator system, the mode switch 13 selects one of the several of operation modes to optimize the pressure for passenger comfort in the elevator cage 2. The pressure monitor 12 detects a rapid change of the pressure, requesting the elevator controller 4 to decrease the speed of the elevator cage 2 to reduce the rapid change for passenger comfort in the elevator cage 2. The mode switch 13 selects the optimization mode to change the pressure at a constant rate for passenger comfort in the elevator cage 2 in the long run mode. The mode switch 13 selects the constant mode for passenger comfort in the elevator cage 2 in a short run mode, the rescue operation, or the check operation to supply substantially the same air volume as the air volume of the exhaust. In the short run mode, the rescue operation, or the check operation, the pressure in the elevator cage 2 is less than a given pressure. The mode switch 13 selects the switching mode to switch on and off the intake blower 9 and the exhaust blower 11 for passenger comfort in the elevator cage 2 even though either the blower controller 22 or the inverter 24 has a problem.

As described, there is both the intake blower 9 and the exhaust blower 11, but either the intake blower 9 or the exhaust blower 11 may be used as both an intake blower and an exhaust blower by counter rotation of the blower. When either the intake blower 9 or the exhaust blower 11 is out of order, another blower can adjust the pressure and ventilate.

According to the embodiment, the elevator system optimizes the pressure in the elevator cage that moves for a long distance at high speed for a comfortable ride.

The present invention may be embodied in other specific forms without departing from the spirit or essential characteristics thereof. The embodiments are therefore to be considered in all respects as illustrative and not restrictive, the scope of the present invention being indicated by the appended claims rather than by the foregoing description, and all changes which come within the meaning and range of equivalency of the claims are therefore intended to be embraced therein.

INDUSTRIAL APPLICABILITY

According to the present invention, the elevator system controls the pressure based on movement of the elevator cage and the pressure in the elevator cage so as to provide a comfortable ride.

The invention claimed is:

1. An elevator system comprising:

an elevator controller;

a blower configured to supply air to or exhaust air from an elevator cage;

a blower controller configured to control the blower through an inverter to adjust pressure inside the elevator cage according to alternative operation modes including an optimization mode in which the pressure changes at a constant rate during the movement of the elevator cage and a constant mode in which the pressure is kept constant during the movement of the elevator cage;

a switch controller configured to switch on and off the blower to adjust pressure inside the elevator cage in a switching mode in which the blower is controlled by switching the blower on and off without using the inverter when the elevator controller determines that the blower does not have a problem and at least one of the blower controller and the inverter has a problem; and a mode switch configured to automatically select an alternative one of the optimization mode, the constant mode and the switching mode.

2. The elevator system of claim 1, wherein the elevator controller is configured to determine whether the pressure in the elevator cage is normal, based on a pressure signal from a pressure sensor;

wherein, when the pressure in the elevator cage is greater than a given pressure and the blower operation is determined to have normal function, the mode switch selects the switching mode so that the switch controller switches on and off the blower by using one of an intake switch and an exhaust switch.

3. The elevator system of claim 2, wherein the mode switch selects the optimization mode when the pressure is greater than a given pressure, and the blower controller controls the blower to change the pressure at a constant rate as the pressure adjusts to a pressure outside the elevator cage when a door of the elevator cage opens in the optimization mode.

4. The elevator system of claim 2, wherein the mode switch selects the constant mode when the pressure is less than a given pressure, and the blower controller controls the blower to supply substantially the same air volume as an exhausted air volume in the constant mode.

5. The elevator system of claim 1, further comprising:

a pressure sensor configured to detect the pressure inside the elevator cage; and a pressure monitor configured to monitor the pressure inside the elevator cage based on a pressure signal from the pressure sensor and to control speed of the elevator cage based on the pressure signal.

6. The elevator system of claim 5, wherein the pressure monitor requests the elevator controller to decrease the speed of the elevator cage to a given speed when the pressure is greater than a given pressure.

7. The elevator system of claim 1, wherein the blower takes in and exhausts air by changing rotational direction of the blower.

8. The elevator system of claim 1, wherein, in a long run mode, the blower controller controls the volume of air of the blower so that the pressure changes at a constant rate in the optimization mode.

* * * * *